US009134670B2

(12) United States Patent
Furuta

(10) Patent No.: US 9,134,670 B2
(45) Date of Patent: Sep. 15, 2015

(54) IMAGE FORMING APPARATUS THAT DETECTS PHASE OF PHOTOSENSITIVE DRUM

(71) Applicant: CANON KABUSHIKI KAISHA, Tokyo (JP)

(72) Inventor: Yasutomo Furuta, Abiko (JP)

(73) Assignee: CANON KABUSHIKI KAISHA (JP)

( * ) Notice: Subject to any disclaimer, the term of this patent is extended or adjusted under 35 U.S.C. 154(b) by 0 days.

(21) Appl. No.: 14/196,533

(22) Filed: Mar. 4, 2014

(65) Prior Publication Data

US 2014/0248063 A1 Sep. 4, 2014

(30) Foreign Application Priority Data

Mar. 4, 2013 (JP) ..... 2013-042006
Feb. 21, 2014 (JP) ..... 2014-031428

(51) Int. Cl.
*G03G 15/00* (2006.01)
*G03G 15/043* (2006.01)

(52) U.S. Cl.
CPC ..... *G03G 15/505* (2013.01); *G03G 15/043* (2013.01); *G03G 15/5008* (2013.01); *G03G 2215/00075* (2013.01)

(58) Field of Classification Search
CPC ..... G03G 15/043; G03G 15/5008; G03G 15/505; G03G 2215/00075; G03G 2215/0158
USPC ..... 399/38, 51, 66, 167, 301; 347/116
See application file for complete search history.

(56) References Cited

U.S. PATENT DOCUMENTS 8,620,185 B2 * 12/2013 Kinokuni ..... 399/167
2005/0238388 A1 * 10/2005 Tanaka ..... 399/167

FOREIGN PATENT DOCUMENTS

JP 2006-215269 A 8/2006
JP 2007011166 A * 1/2007
JP 2007025181 A * 2/2007
JP 2008089792 A * 4/2008

* cited by examiner

*Primary Examiner* — Robert Beatty
(74) *Attorney, Agent, or Firm* — Rossi, Kimms & McDowell LLP

(57) ABSTRACT

An image forming apparatus which reduces a time period required to detect a phase of a photosensitive drum without an increase in costs. The apparatus performs exposure control according to a phase of rotation of the drum. A reference position serving as a reference for rotation of the drum is detected when the drum is rotating at a predetermined speed. After the speed of the drum is reduced from the predetermined speed, a first time period is measured which has elapsed from detection of the reference position to a command to stop rotation of the drum. After rotation of the drum is started again, a third time period is measured which has elapsed from reaching of the predetermined speed to detection of the reference position. The phase of the photosensitive drum for performing the control is determined based on the first time period and the third time period.

8 Claims, 11 Drawing Sheets

*FIG. 8*

| DRUM PHASE FROM HP DETECTION POSITION | SHADING DATA (%) |
|---|---|
| 0 | B0 |
| Ax1 | B1 |
| Ax2 | B2 |
| Ax3 | B3 |
| Ax4 | B4 |
| Ax5 | B5 |
| Ax6 | B6 |
| Ax7 | B7 |

IMAGE FORMING APPARATUS THAT DETECTS PHASE OF PHOTOSENSITIVE DRUM

BACKGROUND OF THE INVENTION

1. Field of the Invention

The present invention relates to an image forming apparatus that detects a phase of a photosensitive drum, and forms an image on a sheet using an electrophotographic method.

2. Description of the Related Art

As an electrophotographic image forming apparatus, there is generally known a system in which a surface of a photosensitive drum is uniformly charged, and the charged surface of the photosensitive drum is exposed by an exposure device to thereby form a latent image. In this electrophotographic image forming apparatus, an image is formed according to a potential of the latent image formed on the photosensitive drum.

Therefore, if the photosensitive drum has variation in characteristics, it is not possible to form an image which is uniform within the surface of the photosensitive drum, which causes degradation of image quality. Causes of degradation of image quality include non-uniform density due to variation in charging potential on the surface of the photosensitive drum, and position deviation of the image due to eccentricity of the photosensitive drum.

Conventionally, to correct the above-mentioned non-uniform density and position deviation, there has been proposed a method of correcting non-uniform density and position deviation by controlling a light amount and an exposure position by an exposure device according to a position of the photosensitive drum in a rotational direction (hereinafter referred to as the "drum phase").

On the other hand, in controlling the exposure device according to the drum phase as mentioned above, it is required to detect a phase of the photosensitive drum. As a method of detecting a phase of the photosensitive drum, there is known a method of detecting a phase by providing a home position sensor (hereinafter referred to as the "HP sensor") for the photosensitive drum, and detecting a reference position of the photosensitive drum by the HP sensor.

For example, there has been disclosed a method of detecting a phase of the photosensitive drum by providing two or more HP sensors for the photosensitive drum (see e.g. Japanese Patent Laid-Open Publication No. 2006-215269).

However, in the above-mentioned method of detecting a phase of the photosensitive drum by using the HP sensor, phase detection cannot be performed before the reference position passes over the HP sensor after the photosensitive drum has started to rotate, and hence it takes some time to detect a phase, which reduces productivity.

Although in the method disclosed in Japanese Patent Laid-Open Publication No. 2006-215269, it is considered that by providing two or more HP sensors, it is possible to reduce the phase detection time compared with the arrangement having one HP sensor. However, there is a problem that the use of a plurality of HP sensors results in an increase in costs.

SUMMARY OF THE INVENTION

The present invention reduces a time period required to detect a phase of a photosensitive drum without an increase in costs.

In a first aspect of the present invention, there is provided an image forming apparatus including a photosensitive drum, comprising an image formation unit configured to form an image on the photosensitive drum, a detection unit configured to detect a reference position serving as a reference for rotation of the photosensitive drum when the photosensitive drum is rotating at a predetermined speed, a first time period measurement unit configured to measure a first time period from when the reference position is detected by the detection unit to when rotation of the photosensitive drum is stopped, after the speed of rotation of the photosensitive drum is reduced from the predetermined speed, a third time period measurement unit configured to measure a third time period which has elapsed from when the speed of rotation of the photosensitive drum reached the predetermined speed to when the reference position is detected by the detection unit, after rotation of the photosensitive drum is started again, a phase determination unit configured to determine a phase of the photosensitive drum based on the first time period and the third time period, and a control unit configured to control the image formation unit based on the phase of the photosensitive drum determined by the phase determination unit.

In a second aspect of the present invention, there is provided an image forming apparatus including a photosensitive drum, comprising an image formation unit configured to form an image on the photosensitive drum, a detection unit configured to detect a reference position serving as a reference for rotation of the photosensitive drum when the photosensitive drum is rotating at a predetermined speed, a first rotation amount determination unit configured to determine a first rotation amount over which the photosensitive drum has rotated from when the reference position is detected by the detection unit to when rotation of the photosensitive drum is stopped, after the speed of rotation of the photosensitive drum is reduced from the predetermined speed, a third rotation amount determination unit configured to determine a third rotation amount over which the photosensitive drum has rotated from when the speed of rotation of the photosensitive drum reached the predetermined speed to when the reference position is detected by the detection unit, and a speed reduction control unit configured to determine a second rotation amount by subtracting the first rotation amount and the third rotation amount from a circumferential length of the photosensitive drum, and in reducing the speed of rotation of the photosensitive drum from the predetermined speed, reduce the speed of rotation of the photosensitive drum when the photosensitive drum has rotated over the second rotation amount after the reference position is detected by the detection unit.

According to the present invention, it is possible to reduce a time period required to detect a phase of a photosensitive drum without an increase in costs.

Further features of the present invention will become apparent from the following description of exemplary embodiments with reference to the attached drawings.

BRIEF DESCRIPTION OF THE DRAWINGS

FIG. 8 is a diagram showing shading data associated with phases of the photosensitive drum, stored in a memory appearing in FIG. 3.

DESCRIPTION OF THE EMBODIMENTS

The present invention will now be described in detail below with reference to the accompanying drawings showing embodiments thereof.

Figure 1:
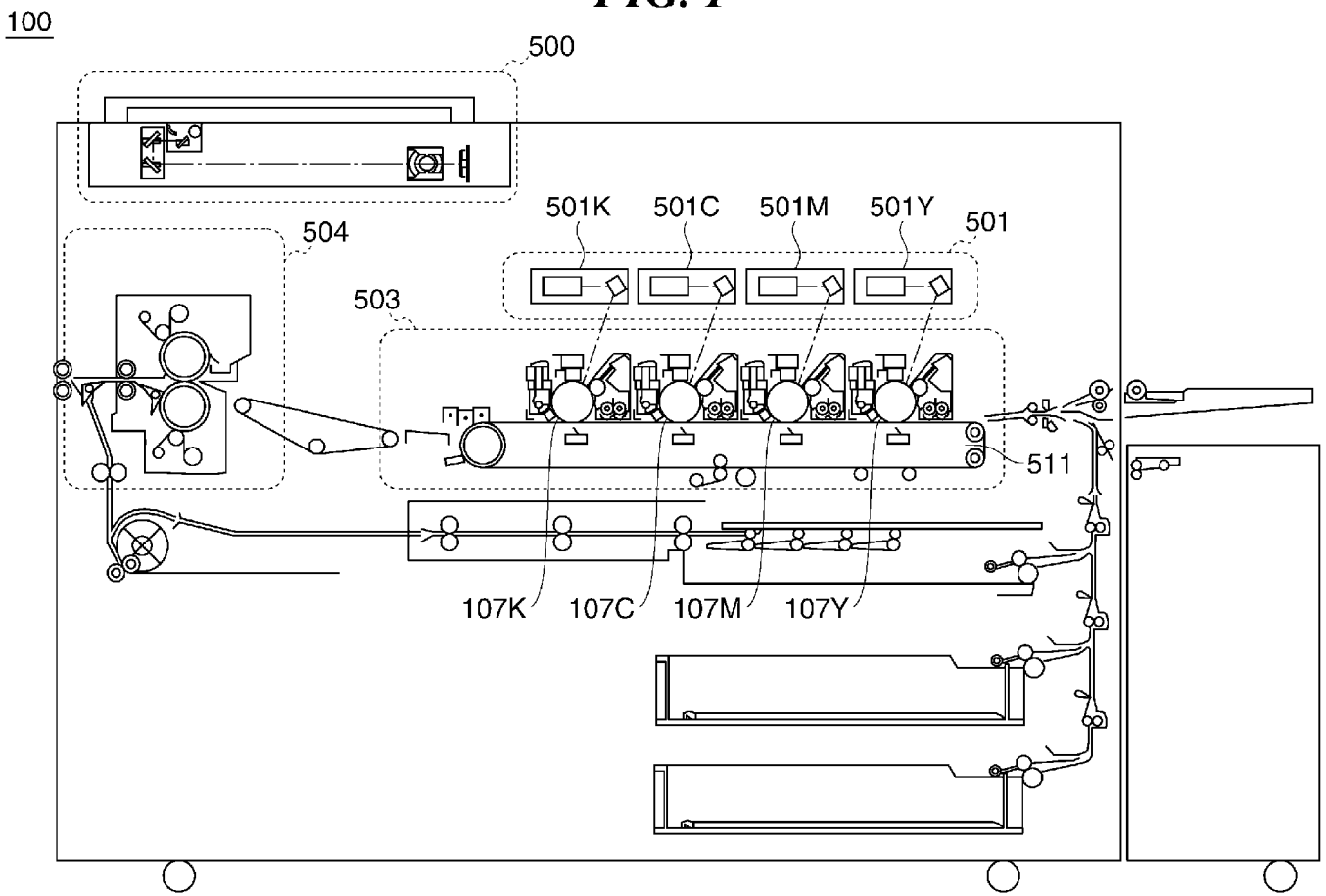
FIG. 1 is a schematic diagram of an image forming apparatus according to an embodiment of the present invention.

FIG. 1 is a schematic diagram of an image forming apparatus 100 according to an embodiment of the present invention.

Referring to FIG. 1, the image forming apparatus 100 includes a scanner section 500, exposure devices 501C, 501M, 501Y, and 501K, photosensitive drums 107C, 107M, 107Y, and 107K, an image forming section 503, and a fixing section 504. In the following description, the exposure devices and the photosensitive drums denoted by reference numerals with C, M, Y, or K are expressed as the exposure devices 501 and the photosensitive drums 107 in a case where they are not required to be distinguished from each other.

The scanner section 500 irradiates an original placed on an original platen glass with illuminating light, optically reads an image of the original, and converts the read image to an electric signal to thereby generate image data. Each exposure device 501 emits light according to the image data, and irradiates an associated one of the photosensitive drums 107 with the emitted light.

The image forming section 503 drives the photosensitive drum 107 for rotation, charges the photosensitive drum 107 with an electrostatic charger, not shown, and then develops a latent image formed by the exposure device on the respective photosensitive drum 107 with toner.

Then, the image forming section 503 transfers the toner image onto a sheet on a transfer member 511 in the form of a belt. At this time, toner remaining on the photosensitive drum 107, which has not been transferred, is collected.

The image forming apparatus 100 includes image forming sections (image forming station) for respective colors of yellow (Y), magenta (M), cyan (C), and black (K), and execute the above-described series of electrophotographic processes, to thereby form four-color toner images.

The toner images of the respective colors of Y, M, C, and K are sequentially transferred onto a sheet conveyed on the transfer member 511 in superimposed relation, whereby a full-color toner image having no color shift is formed. The fixing section 504 which is composed of a combination of rollers and belts and incorporates a heat source, such as a halogen heater, so as to melt and fix the toner on the sheet to which the toner image has been transferred, with heat and pressure.

The image forming apparatus 100 is provided with a CPU 101 (see FIG. 3) which that controls each of the above-described components. The CPU 101 controls the image formation operation while controlling the state of the scanner section, the exposure devices, and each of the components associated with image formation, fixing, and sheet feeding/conveyance. The CPU 101 will be described hereinafter.

Figure 2:
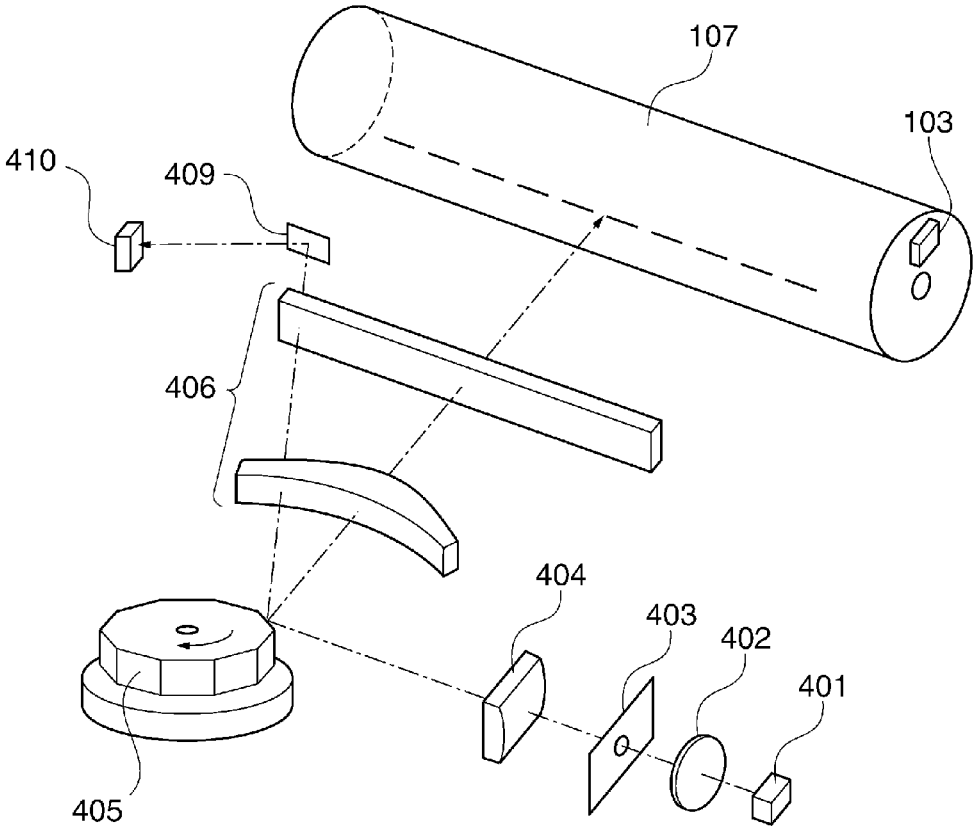
FIG. 2 is a diagram of an exposure device and a photosensitive drum appearing in FIG. 1.

FIG. 2 is a diagram of the exposure device 501 and the photosensitive drum 107 appearing in FIG. 1.

Referring to FIG. 2, the exposure device 501 includes a semiconductor laser 401, a collimator lens 402, a diaphragm 403, a cylindrical lens 404, a polygon mirror 405, an f-θ lens 406, a reflection mirror 409, and a BD sensor 410.

The semiconductor laser 401 performs light emission with a desired light amount based on a control signal from a sequence controller, not shown, and light emitted from the semiconductor laser 401 passes through the collimator lens 402, the diaphragm 403, and the cylindrical lens 404, whereby a whole light flux forms a flux substantially parallel to the center of the optical axis. Then, the light enters the polygon mirror 405 such that it has a predetermined beam diameter.

The polygon mirror 405 is rotated at an equal angular velocity in a direction indicated by an arrow, and the incident light beam is reflected according to this rotation as a deflected beam which sequentially change the angle thereof.

The light converted to the deflected beam is caused to scan on the surface of the photosensitive drum 107 at a constant speed by the f-O lens 406.

A HP (home position) sensor 103 is disposed in a manner opposed to an end face of the photosensitive drum 107. The HP sensor 103, which comprises light emission elements and light receiving elements, emits light to the end face of the photosensitive drum 107 and monitors the reflected light.

The photosensitive drum 107 has a reflection member, not shown, provided on the end face thereof at a location corresponding to a reference phase, and the reflection member is rotated in synchronism with rotation of the photosensitive drum 107. The HP sensor 103 performs reference phase detection based on a difference in reflectance at a time when the reflection member passes the HP sensor 103.

Figure 3:
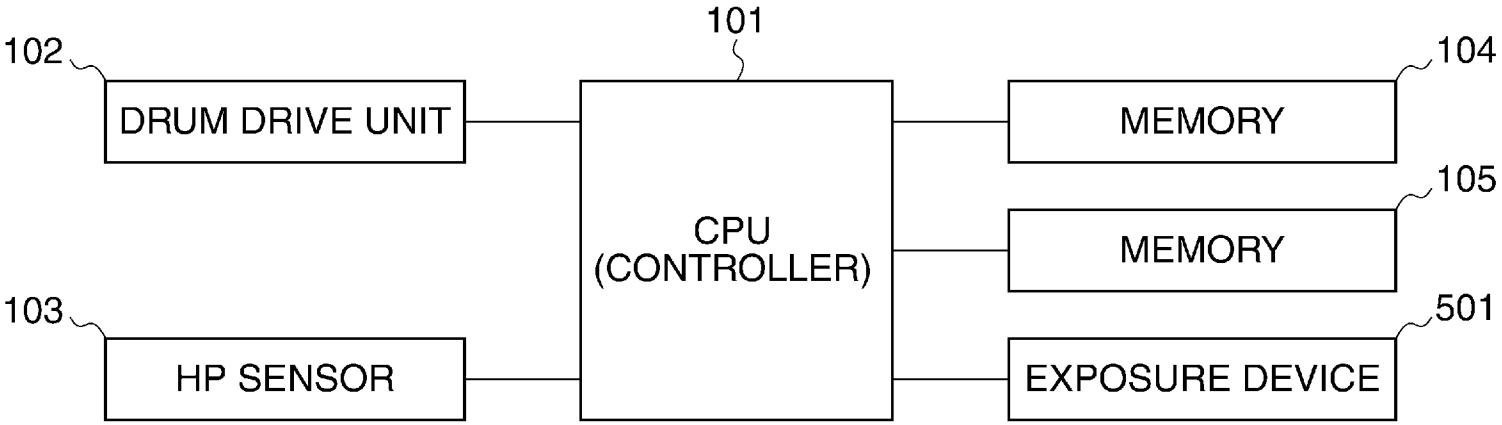
FIG. 3 is a block diagram showing the electrical arrangement for driving the photosensitive drum and controlling the exposure device.

FIG. 3 is a block diagram showing the electrical arrangement for driving the photosensitive drum 107 and controlling the exposure device of the image forming apparatus 100 shown in FIG. 1.

Referring to FIG. 3, the CPU 101 is connected to a drum drive unit 102, the HP sensor 103, memories 104 and 105, and the exposure device 501.

The drum drive unit 102 drives the photosensitive drum 107 according to an instruction from the CPU 101, and outputs a drum speed lock signal to the CPU 101 during rotation of the photosensitive drum 107 at a predetermined speed.

The HP sensor 103 disposed in a manner opposed to the end face of the photosensitive drum 107 outputs a pulse signal to the CPU 101 at the moment when the photosensitive drum 107 reaches the reference phase during rotation of the photosensitive drum 107.

The exposure device 501 is subjected to exposure light amount control by the CPU 101. In the memory 104, starting and stopping distances the photosensitive drum 107 are stored, and the CPU 101 determines a phase immediately after the current start based on the immediately preceding stop instruction position of the photosensitive drum 107 and the starting and stopping distances stored in the memory 104.

In the memory 105, exposure light amount data (hereinafter referred to as the "shading data") associated with the phases of the photosensitive drum 107 is stored.

Then, after detecting the phase of photosensitive drum 107, the CPU 101 sets the shading data to the exposure device 501 according to the detected phase, and performs the exposure light amount control (hereinafter referred to as the "drum shading") in accordance with the phase (position in a rotational direction) of the photosensitive drum 107.

Figure 4:
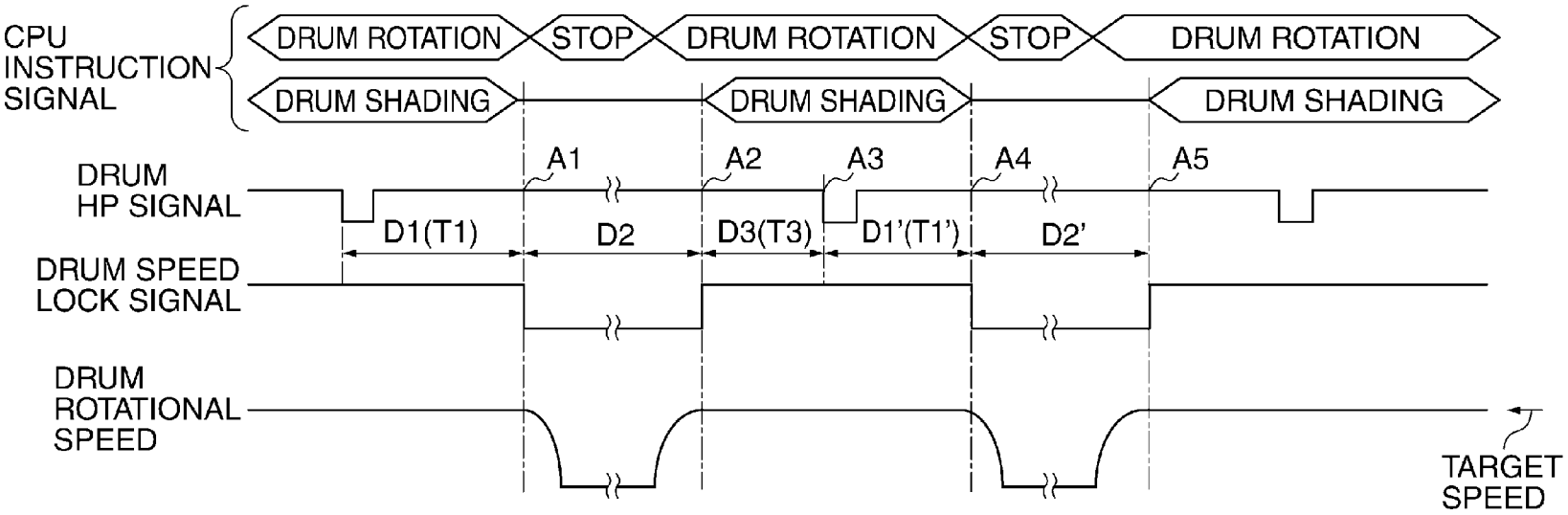
FIG. 4 is a timing diagram of a drum shading process executed by the image forming apparatus according to the present embodiment.

FIG. 4 is a timing diagram of a drum shading process executed by the image forming apparatus according to the present embodiment.

The timing diagram in FIG. 4 shows CPU instruction signals, a drum HP signal, a drum speed lock signal, and a drum rotational speed. The CPU instruction signals are output from the CPU 101 to the drum drive unit 102 and the exposure device 501.

The photosensitive drum 107 is rotated by the drum drive unit 102 according to an instruction from the CPU 101, and the drum shading is executed by the exposure device 501. The drum speed lock signal is high during rotation of the photosensitive drum 107 at a predetermined speed.

The drum HP signal goes at a time when the photosensitive drum 107 reaches the reference phase, and thereafter continues to remain low for a predetermined time period. A distance over which the photosensitive drum 107 moves from when the drum HP signal is detected to when the CPU 101 issues an instruction for stopping the photosensitive drum 107 is defined as a first movement distance D1. That is, the distance D1 is a distance over which the photosensitive drum 107 moves from when the drum HP signal goes low to when the drum speed lock signal goes low.

A movement distance determined by adding a distance over which the photosensitive drum 107 moves from when the CPU 101 issues an instruction for stopping the photosensitive drum 107 to when the photosensitive drum 107 completely stops, and a distance over which the photosensitive drum 107 moves from when the photosensitive drum 107 completely stops to when the photosensitive drum 107 is increased in rotational speed to a predetermined speed is defined as a second movement distance D2. That is, the distance D2 is a distance over which the photosensitive drum 107 moves from when the drum speed lock signal goes low to when the drum speed lock signal goes high.

A distance over which the photosensitive drum 107 moves from when the rotational speed of the photosensitive drum 107 reaches the predetermined speed to when the drum HP signal goes low is defined as a third movement distance D3. Note that T1 and T3 in FIG. 4 indicate count values counted by respective counters realized by a program, and are used in processes, described hereinafter.

First, the first movement distance D1 is measured by the CPU 101 at a time point A1. That is, the first movement distance D1 is determined based on the count value T1. Next, the third movement distance D3 is measured by the CPU 101 at a time point A3. That is, the third movement distance D3 is determined based on the count value T3. The sum of the first, second, and third movement distances D1, D2, and D3 is equal to the circumferential length of the drum, and hence the second movement distance D2 is determined by subtracting the first and third movement distances D1 and D3 from the known circumferential length of the drum, using the following equation (1):

$$\text{second movement distance } D2 = \text{drum circumferential length} - (\text{first movement distance } D1 + \text{third movement distance } D3) \quad (1)$$

For example, when the diameter of the drum is equal to 80 mm, the circumferential length of the drum is approximately equal to 251 mm. The first and third movement distances D1 and D3 vary depending on the timing in which the drum stop instruction from the drum HP signal is issued after a job is terminated, and hence are different in value every time. Therefore, the second movement distance D2 which is the sum of the drum stopping distance and the drum starting distance varies with time within a range of 10 to 50 mm as an example.

Next, the first movement distance D1' is measured by the CPU 101 at a time point A4, and a drum phase at the next start of the photosensitive drum 107 is determined based on the first and second movement distances D1' and D2, using the following equation (2):

$$\text{drum phase at next start} = \text{first movement distance } D1' + \text{second movement distance } D2 \quad (2)$$

In the present embodiment, the drum phase at the next start is determined based on the second movement distance D2 determined for a preceding stop and the first movement distance D1' measured for a current stop. That is, the drum phase at the next start is determined based on the latest values of D1 and D2. The first, second, and third movement distances D1, D2, and D3 are measured or determined whenever the photosensitive drum 107 is started and stopped, and the data stored in the memory 104 is updated each time. Thus, the second movement distance D2 is determined whenever the photosensitive drum 107 is rotated and stopped.

Figure 5:
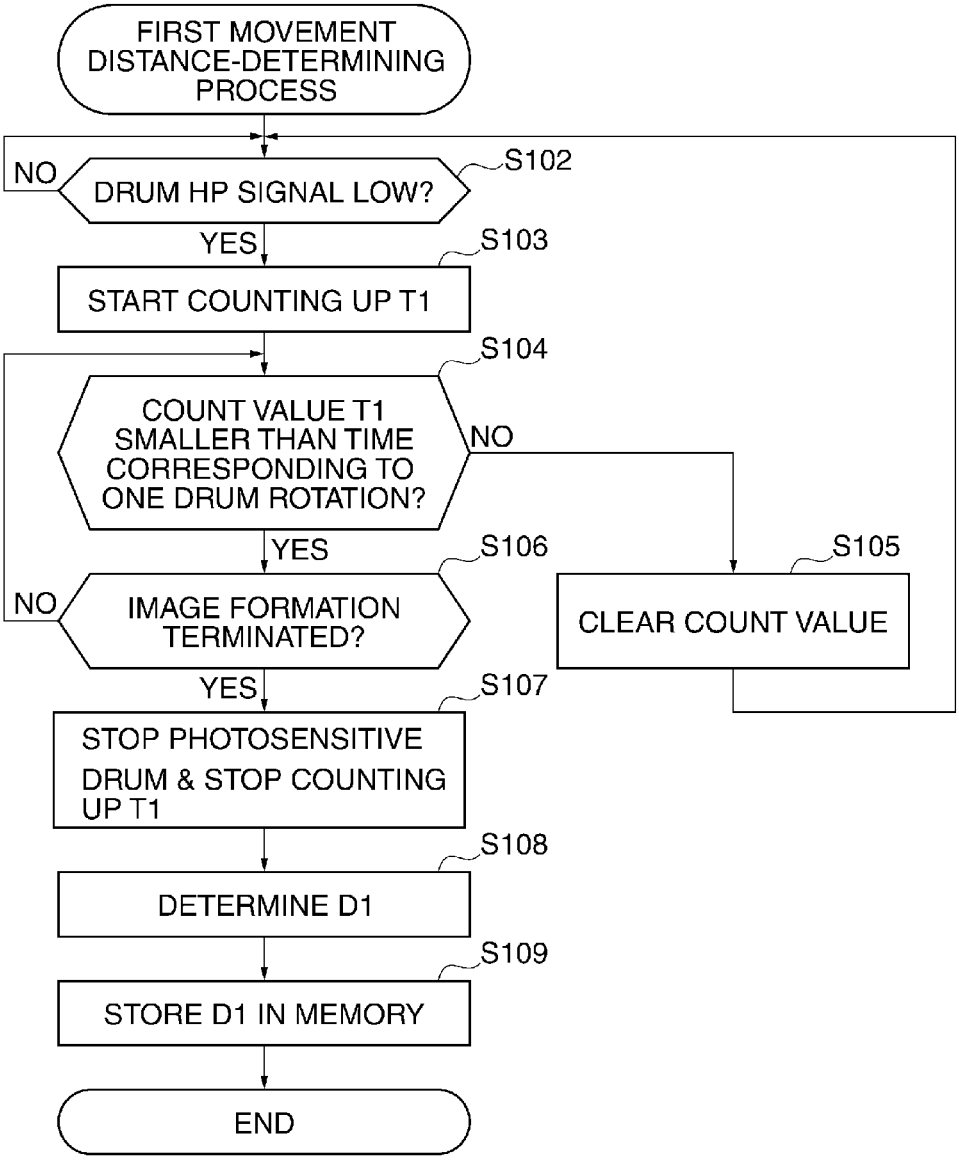
FIG. 5 is a flowchart of a first movement distance-determining process executed by the CPU.

FIG. 5 is a flowchart of a first movement distance-determining process executed by the CPU 101.

The first movement distance-determining process in FIG. 5 is executed during image formation. First, when it is detected by the CPU 101 that the drum HP signal has gone low (YES to a step S102), the CPU 101 starts counting up a count value T1 using a counter for counting time (step S103).

Next, the CPU 101 determines whether or not the count value T1 is smaller than a value corresponding to one rotation of the photosensitive drum 107 (step S104). If it is determined in the step S104 that the count value T1 is not smaller than the value corresponding to one rotation of the photosensitive drum 107 (NO to the step S104), the CPU 101 clears the count value T1 (step S105), and returns to the step S102.

On the other hand, if it is determined in the step S104 that the count value T1 is smaller than the value corresponding to one rotation of the photosensitive drum 107 (YES to the step S104), the CPU 101 determines whether or not image formation has been terminated (step S106). The determination that image formation has been terminated is performed based on discharge of the last sheet for the print job from the image forming apparatus 100. Note that the determination may be performed based on completion of transfer of the last toner image onto a sheet.

If it is determined in the step S106 that image formation has not been terminated (NO to the step S106), the CPU 101 returns to the step S104.

On the other hand, if it is determined in the step S106 that image formation has been terminated (YES to the step S106), the CPU 101 instructs the drum drive unit 102 to stop the photosensitive drum 107, and at the same time stops counting up the count value T1 (step S107).

Then, the CPU 101 determines the first movement distance D1 based on the count value T1 and a known surface speed v during drum rotation by the following equation (3) (step S108):

$$\text{first movement distance } D1 = \text{count value } T1 \times \text{surface speed } v \text{ during drum rotation} \quad (3)$$

The CPU 101 stores the determined first movement distance D1 in the memory 104 (step S109), followed by terminating the present process. The step S108 corresponds to a first time determination unit (first distance determination unit) configured to determine a first time period which has elapsed after detection of a reference position, when the photosensitive drum 107 starts to be reduced in rotational speed from a predetermined speed. The first distance is determined from the first time period.

Figure 6:
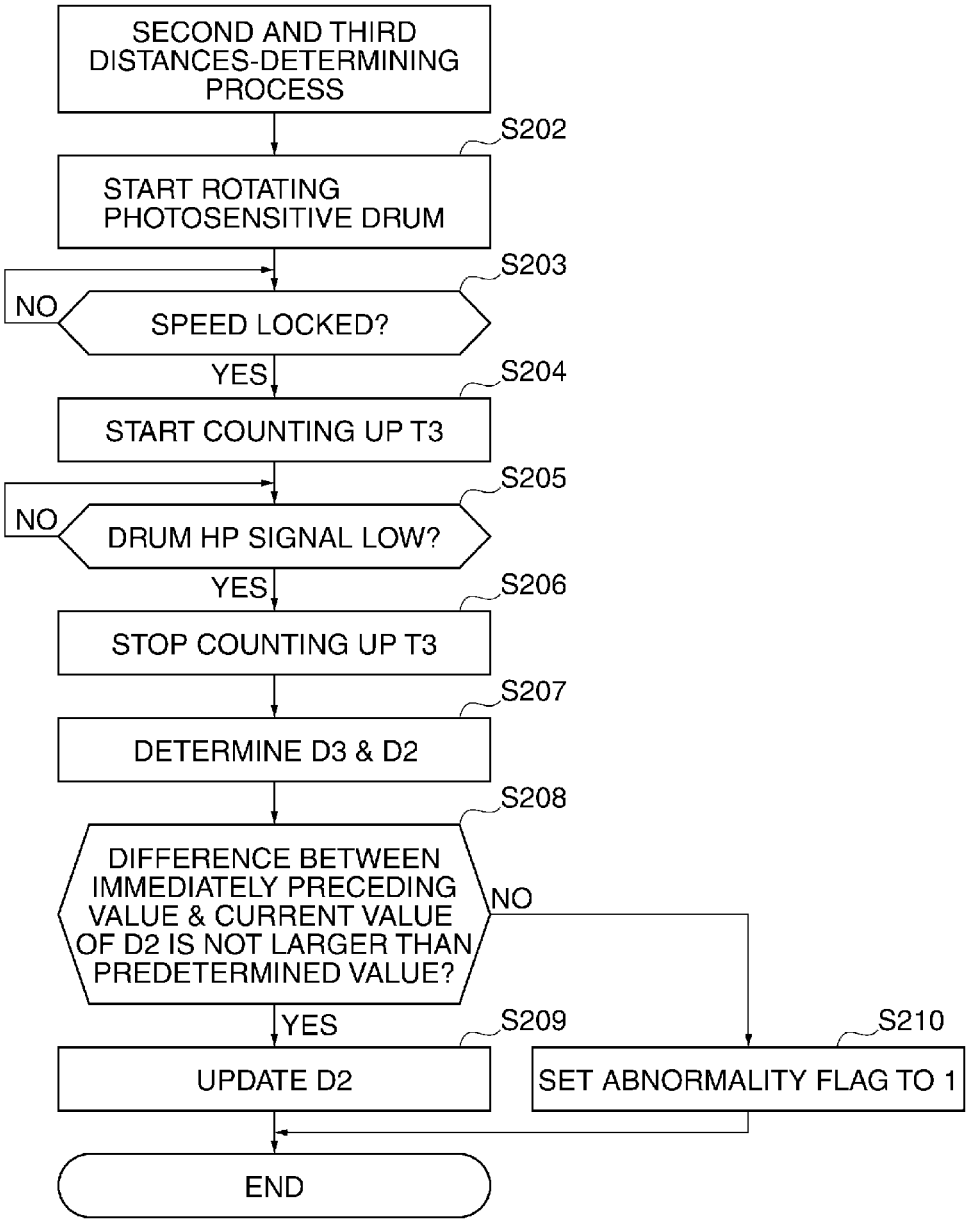
FIG. 6 is a flowchart of a second and third movement distances-determining process executed by the CPU.

FIG. 6 is a flowchart of a second and third movement distances-determining process executed by the CPU 101.

The second and third movement distances-determining process in FIG. 6 is executed at the start of image formation. First, the CPU 101 instructs the drum drive unit 102 to start rotation of the photosensitive drum 107 (step S202). Next, when the CPU 101 detects from the drum speed lock signal that the rotational speed is locked (YES to a step S203), the CPU 101 starts counting up a count value T3 using a counter for counting time at the time when the rotational speed is locked (step S204).

Then, when the CPU 101 detects that the drum HP signal has gone low (YES to a step S205), the CPU 101 stops counting up the count value T3 (step S206). Then, the CPU 101 determines the third movement distance D3 and the second movement distance D2 (step S207). More specifically, first, the CPU 101 determines the third movement distance D3 based on the count value T3 by the following equation (4):

$$\text{third movement distance } D3 = \text{count value } T3 \times \text{photosensitive drum surface speed } v \quad (4)$$

Then, the CPU 101 determines the second movement distance D2 based on the determined third movement distance D3 and the first movement distance D1 read from the memory 104 by the equation (1). The step S207 corresponds to the operation of a third time determination unit (third distance determination unit) configured to determine a third time period which has elapsed from when the photosensitive drum 107 reached the predetermined speed after starting to be rotated to when the reference position is detected. The third distance is determined from the third time period.

Then, the CPU 101 reads the second movement distance D2 determined last time from the memory 104, and compares the read value with the current value of second movement distance D2 to thereby determine whether or not a difference between the immediately preceding value and the current value of the second movement distance D2 is not larger than a predetermined value (step S208).

If it is determined in the step S208 that the difference between the immediately preceding value and the current value of the second movement distance D2 is not larger than the predetermined value (YES to the step S208), the CPU 101 updates the second movement distance D2 stored in the memory 104 by the value determined this time (step S209), followed by terminating the present process.

On the other hand, if it is determined in the step S208 that the difference between the immediately preceding value and the current value of the second movement distance D2 is larger than the predetermined value (NO to the step S208), the CPU 101 sets an abnormality flag indicative of occurrence of abnormality to 1, which indicates occurrence of abnormality (step S210), followed by terminating the present process.

The step S102 in the above-described first movement distance-determining process and the step S205 in the second and third movement distances-determining process correspond to the operation of a detection unit configured to detect a reference position used as a reference of rotation of the photosensitive drum 107, when the photosensitive drum 107 is rotated at the predetermined speed.

Figure 7:
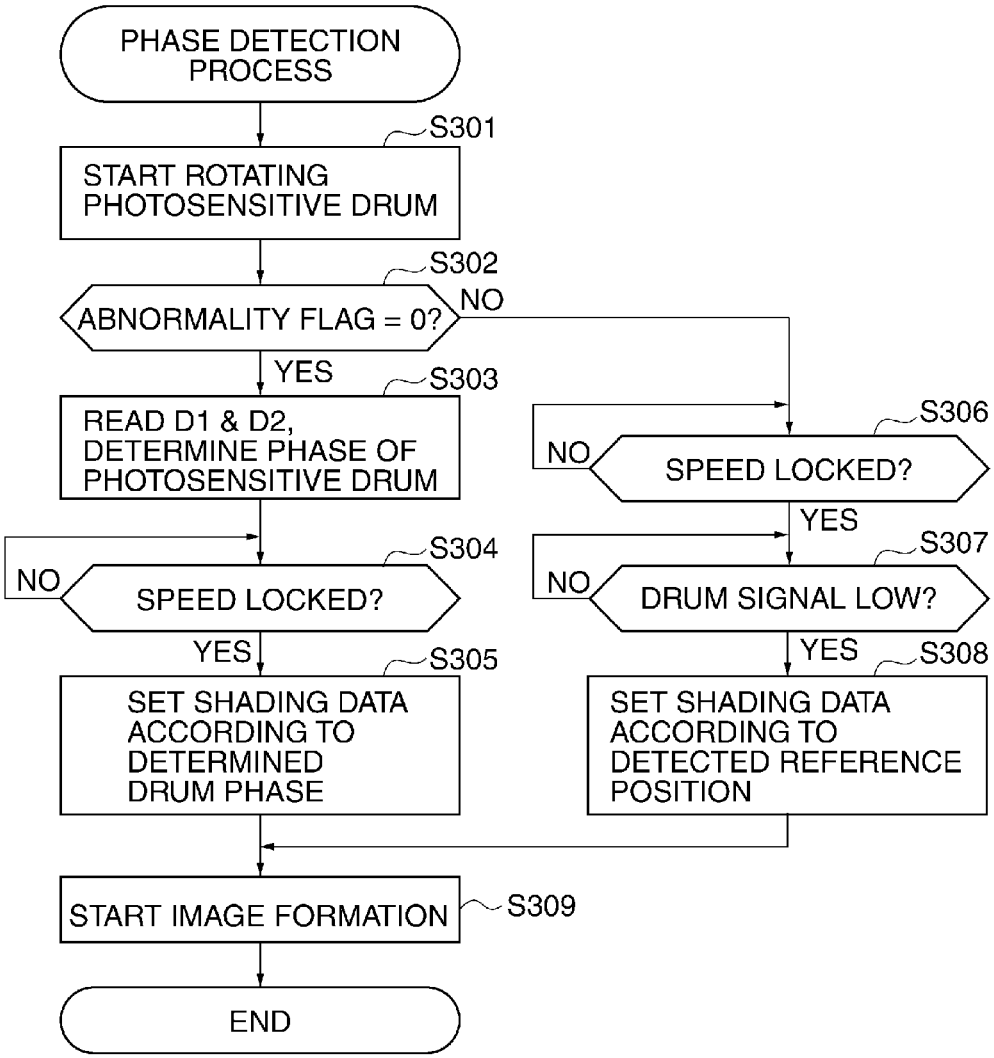
FIG. 7 is a flowchart of a phase detection process executed by the CPU.

FIG. 7 is a flowchart of a phase detection process executed by the CPU 101.

The phase detection process in FIG. 7 is executed at the start of image formation. First, the CPU 101 instructs the drum drive unit 102 to rotate the photosensitive drum (step S301), and determines whether or not the abnormality flag is equal to 0 (step S302). If the abnormality flag is not equal to 0, this means that the phase of the photosensitive drum 107 is known, and hence the CPU 101 reads the first and second movement distances D1 and D2 from the memory 104, and determines a drum phase at a time when the speed of the photosensitive drum 107 is locked at a target speed by using the equation (2) (step S303). Although in the step S303, the first and second movement distances D1 and D2 are used, the first and second movement distances D1 and D2 are determined by the count values T1 and T2, respectively. Therefore, the step S302 corresponds to the operation of a phase determination unit configured to determine, based on the first time period and the third time period, a phase of the photosensitive drum 107 to be controlled. Further, as described above, the CPU 101 determines the phase of the photosensitive drum 107 based on the second movement distance D2 determined by subtracting the first movement distance D1 and the third movement distance D3 from the known circumferential length of the photosensitive drum 107.

When the CPU 101 detects from the drum speed lock signal that the speed of the photosensitive drum 107 is locked (YES to the step S304), the CPU 101 makes settings such that the exposure light amount control is started from shading data corresponding to the phase determined in the step s303 to thereby start image formation (step S309).

On the other hand, if it is determined in the step S302 that the abnormality flag is not equal to 0 (NO to the step S302), the phase of the photosensitive drum 107 is not known. Therefore, when the CPU 101 detects from the drum speed lock signal that the speed of the photosensitive drum 107 is locked (YES to a step S306), and detects that the drum HP signal has gone low (YES to a step S307), the CPU 101 judges that the drum phase has reached the reference position, and sets the shading data according to the reference position (step S308) to thereby start image formation (step S309).

As described above, when the difference between the newly determined second movement distance D2' and the second movement distance D2 determined last time is larger than the predetermined value (when the abnormality flag is not equal to 0), the exposure control using the phase determined by the detected reference position is performed.

FIG. 8 is a diagram showing the shading data associated with the phases of the photosensitive drum, stored in the memory 105.

In the present embodiment, the surface of the photosensitive drum 107 is divided into eight areas in a sub scanning direction (rotational direction) with reference to a position detected by the HP sensor 103, and as shown in FIG. 8, shading data associated with each area is stored in the memory 105.

The memory 105 stores the shading data associated with each drum phase as described above, and the CPU 101 sets the shading data to the exposure device 501 according to the phase of rotation of the photosensitive drum 107 to thereby perform the exposure control.

Figure 9:
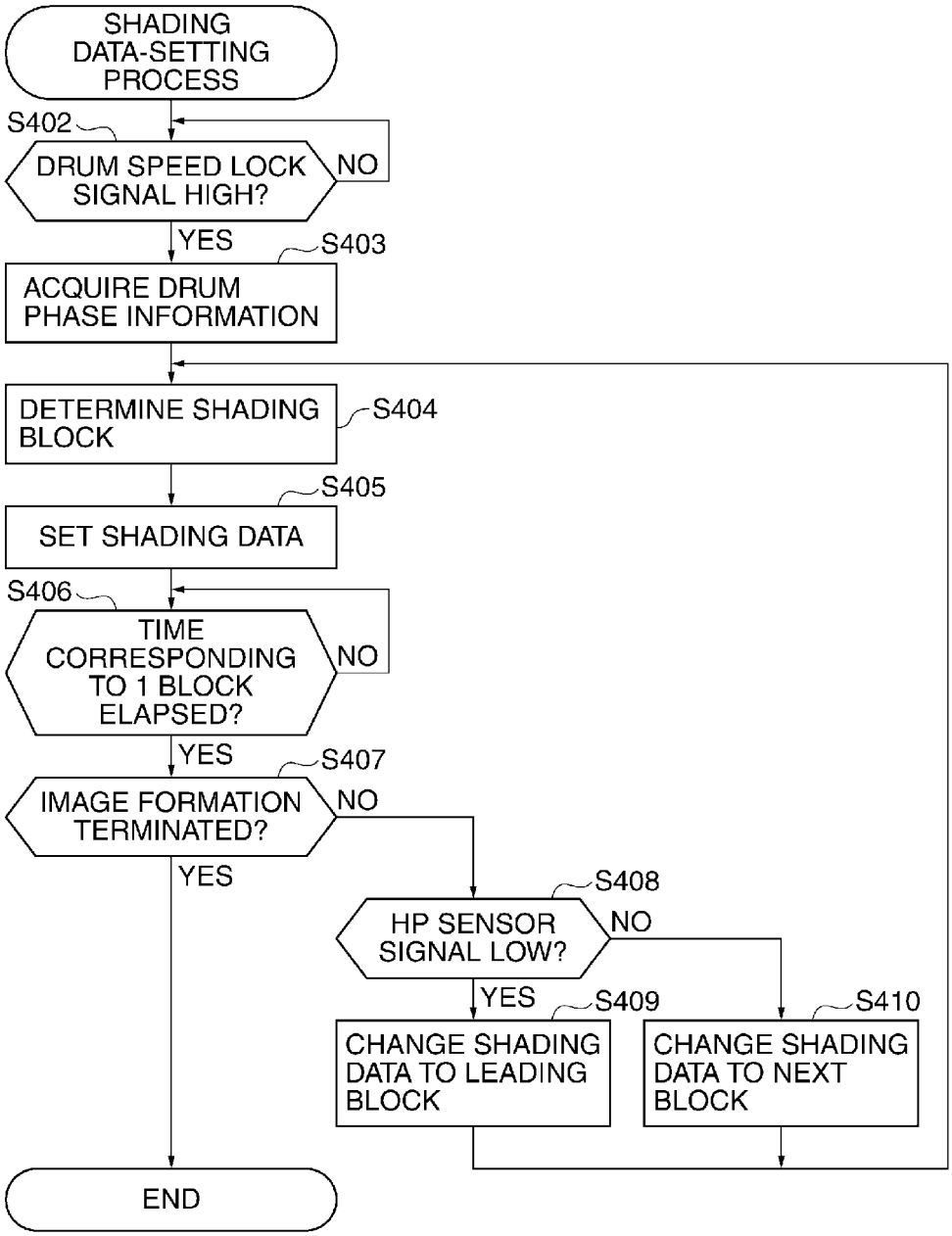
FIG. 9 is a flowchart of a shading data-setting process executed by the CPU.

FIG. 9 is a flowchart of a shading data-setting process executed by the CPU 101.

The process in FIG. 9 is executed during image formation. First, when image formation is started, the CPU 101 monitors the drum speed lock signal, and when the drum speed lock signal has gone high (YES to a step S402), the CPU 101 acquires drum phase information (step S403).

The drum phase information was determined by the equation (2) at the time when the drum was stopped last time.

Then, the CPU 101 determines a shading block to be corrected out of the eight divided shading blocks (step S404). For example, when it is immediately after the start of the drum, a block corresponding to the phase at the start of the drum, determined in the step S403, is determined as the shading block to be corrected.

Then, the CPU 101 reads the light amount correction data corresponding to the block determined as the shading block to be corrected from the memory 105, and sets the shading data (step S405). Then, the CPU 101 waits for a time period required for the photosensitive drum 107 to move by one block to elapse (step S406), when the time period has elapsed, the CPU 101 determines whether or not image formation is terminated (step S407).

In the step S406, a block size of the photosensitive drum 107 and a time period required for the photosensitive drum 107 to move by one block of the rotational speed are determined, and whether or not the determined time has elapsed is determined by checking a result of time measurement by the CPU 101.

If it is determined in the step S407 that image formation is terminated (YES to the step S407), the present process is terminated.

On the other hand, if it is determined in the step S407 that the image formation is not terminated (NO to the step S407), the CPU 101 determines whether or not the output from the HP sensor 103 is low (step S408).

If it is determined in the step S408 that the output from the HP sensor 103 is not low (NO to the step S408), it means that the photosensitive drum 107 has been rotated to the next block, and hence the CPU 101 changes the shading data to data for the next block (step S410), and proceeds to the step S404.

On the other hand, if it is determined in the step S408 that the output from the HP sensor 103 is low (YES to the step S408), it means that the photosensitive drum 107 is at a point for detection by the HP sensor 103, and hence the CPU 101 changes the shading data to data at a leading block (step S409), and proceeds to the step S404.

The leading block refers to a block of data associated with a location where the output from the HP sensor 103 goes low. By execution of the above-described process, the shading data is set according to each shading block.

Figure 10:
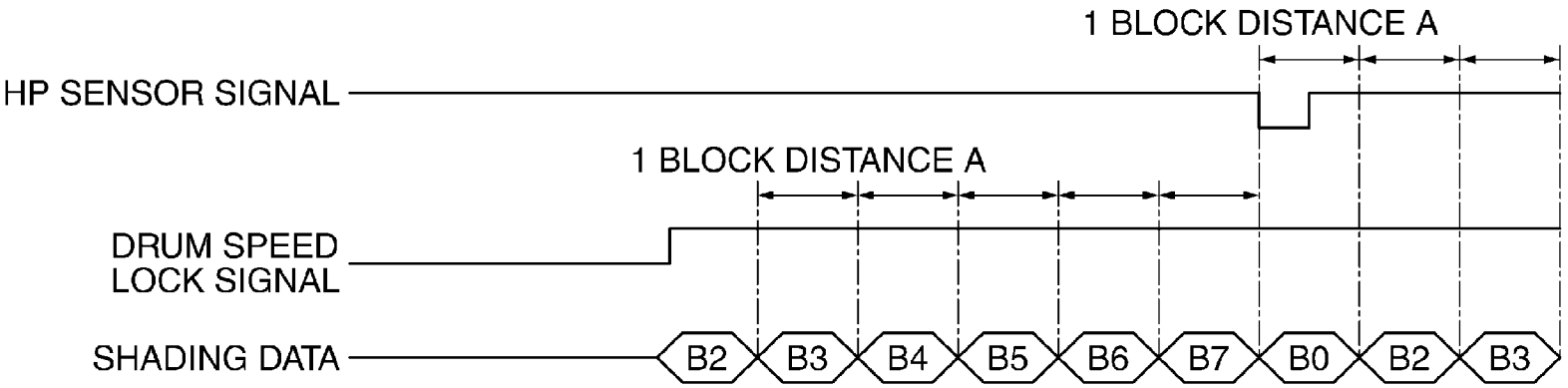
FIG. 10 is a timing diagram of the shading data-setting process in FIG. 9.

FIG. 10 is a timing diagram of the shading data-setting process in FIG. 9.

Referring to FIG. 10, first, after the photosensitive drum 107 has started to be rotated, when the rotational speed becomes constant, the drum speed lock signal changes from low to high. As described hereinabove, in the present embodiment, the phase of the photosensitive drum 107 is detected when the rotational speed of the photosensitive drum 107 becomes constant, and hence the shading data corresponding to the phase detected when the drum speed lock signal has changed to high is read from the memory 105, and is set.

Thereafter, the shading data is sequentially read and set at predetermined time intervals, whereby the change of the shading data and the start of a shading operation are executed according to the drum phase.

As described above, in the present embodiment, it is possible to perform image formation without reducing productivity without waiting for the photosensitive drum 107 to rotate by one rotation before the HP sensor 103 detects a phase. After detection of the phase by the HP sensor 103, phase detection is performed with reference to the time of detection by the HP sensor 103, and hence it is possible to periodically perform phase detection even when the image formation operation is continuously performed.

On the other hand, the movement distance (stopping distance) over which the photosensitive drum 107 moves from when an instruction for stopping rotation of the photosensitive drum 107 is issued to when the photosensitive drum 107 stops is compared between the immediately preceding result of the determination and the current result of the same, and if a change in the stop stance is large e.g. due to an unplanned load variation, the control is changed to the conventional phase detecting sequence using the drum HP signal.

This generates a waiting time for phase detection, but it is possible to prevent an unplanned erroneous operation. Further, the stopping distance is constantly updated to a latest result of measurement and determination, whereby it is possible to detect a phase with higher accuracy by canceling out an amount of change in the stopping distance due to aging of a motor or aged deterioration of a friction amount.

In the present embodiment, the description has been given of a procedure of the drum shading correction which is an example of the exposure control as the control using the phase of the photosensitive drum 107. The above-described control can be applied not only to the drum shading, but also to general control of operation performed according to the phase of the photosensitive drum 107.

For example, the above-described control can also be applied to a technique for correcting an exposure image position according to the phase of the photosensitive drum 107 to correct color shift caused by variation in shape, such as eccentricity, of the photosensitive drum 107.

For example, in a case where the drum surface speed at the exposure position varies at a repetition period of rotation due to eccentricity of the photosensitive drum 107 with respect to the center of the axis, image magnification varies in the sub scanning direction at the repetition period of rotation.

The amount of eccentricity of the drum of each color has variation caused by manufacturing variation, and hence the variation in image magnification at the repetition period of rotation of each photosensitive drum varies from one color to another, causing color shift.

To correct the image magnification varying at the repetition period of rotation, there has been proposed a technique of correcting the image position by shifting the exposure timing or the image data position in the sub scanning direction according to the drum phase.

The present invention in which a drum phase is detected with high accuracy is also effective in using the above-mentioned technique of correcting the image position according to the drum phase.

Further, although in the present embodiment, the first, second, and third movement distances D1, D2, and D3 are used for phase determination of the photosensitive drum 107, the same result can be obtained by performing determination based on the movement time (rotation time) or an angle of rotation. Note that the circumferential length of the drum corresponds to an angle of rotation of 360 degrees.

In the above-described embodiment, termination of image formation is performed without particularly controlling the stop position of the photosensitive drum 107. In this case, a phase at the next start is detected from the immediately preceding stop time T1, and hence an error in phase detection is likely to be generated.

To eliminate this problem, the drum stop position at the time of preceding termination of image formation may be adjusted such that when next image formation is started, the drum HP signal will be detected immediately after the photosensitive drum 107 starts to rotate and the drum speed lock signal goes high.

Figure 11:
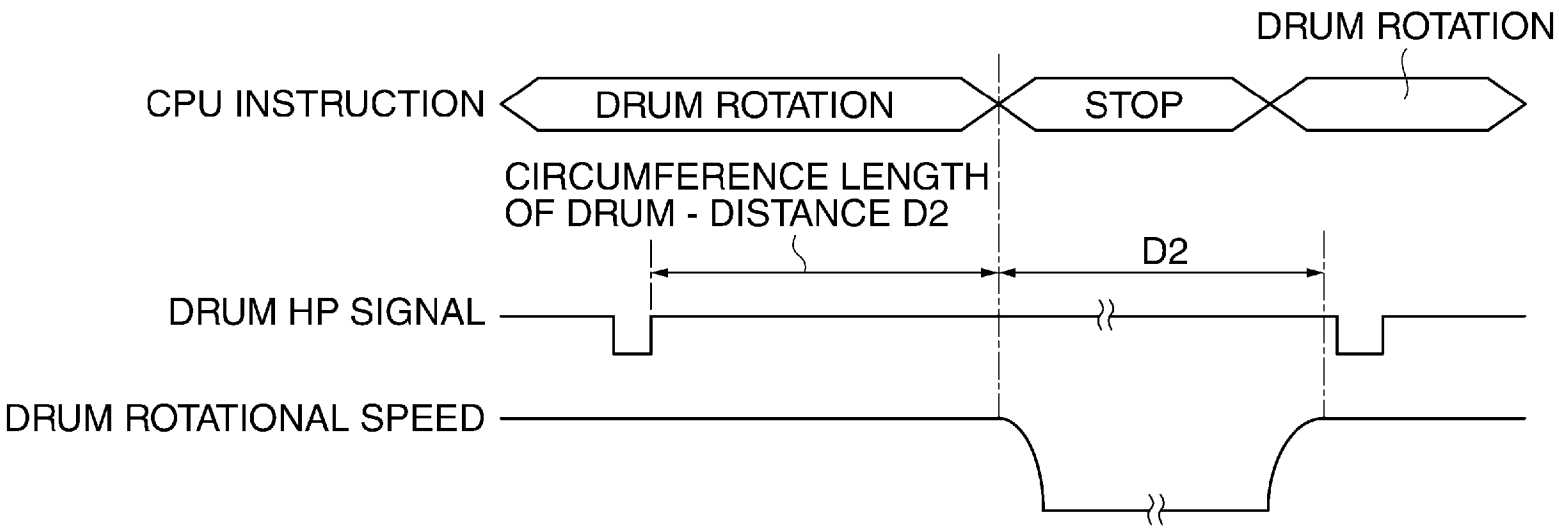
FIG. 11 is a timing diagram of a drum shading process according to a variation of the embodiment of the image forming apparatus, in which a drum stop position is adjusted.

FIG. 11 is a timing diagram of the drum shading process according to a variation of the embodiment of the image forming apparatus in which the drum stop position is adjusted.

Referring to FIG. 11, after the drum HP signal is detected, the operation for stopping the photosensitive drum 107 is started when the photosensitive drum 107 is rotated by a distance determined by subtracting the second movement distance D2 from the circumferential length of the photosensitive drum 107. As a consequence, the drum phase detection is performed in timing of detection of the drum HP signal after starting rotation of the photosensitive drum 107, and the drum shading is started. Thus, according to the variation of the image forming apparatus, the second movement distance D2 is determined by subtracting the first movement distance D1 and the third movement distance D3 from the circumferential length of the photosensitive drum 107, and in reducing the speed of the photosensitive drum from the predetermined speed next time, speed reduction control is performed such that the speed of rotation of the photosensitive drum 107 is reduced after the photosensitive drum 107 rotates over the second movement distance D2 after detection of the reference position.

In FIG. 11, the photosensitive drum 107 stops at a position where the drum HP signal is to be detected immediately after the next start thereof, and hence it is possible to start to control the exposure device immediately after the start, and perform image formation without reducing productivity.

Although the method shown in FIG. 11 is disadvantageous in that to always stop the photosensitive drum 107 at the predetermined position, it takes some time to completely stop the photosensitive drum 107, phase detection is always performed based on the output from the HP sensor 103, and hence it is possible to perform phase detection with high accuracy.

Although in FIG. 11, the operation for stopping the photosensitive drum 107 is started when the photosensitive drum 107 has rotated over a distance determined by subtracting the second movement distance D2 from the circumferential length of the photosensitive drum 107, the stop operation may be started at a position before the above-mentioned position by a distance, which takes into account variation in stop and start operations.

Further, also in the above-described variation, the stop position may be adjusted using the time of rotation or an angle of rotation in place of the distance D2.

As described heretofore, according to the present embodiment and the variation thereof, in the image forming apparatus that controls the exposure device according to the phase of the photosensitive drum 107, and corrects non-uniform density and deviation of image position, it is possible to provide an image forming apparatus that performs phase detection immediately after the start of the photosensitive drum, and performs a correction operation without reducing productivity.

Further, it is possible to detect a phase of the photosensitive drum 107 immediately after the photosensitive drum 107 starts to rotate, which makes it possible to detect a phase without waiting for detection of a signal from the HP sensor 103.

Further, after the reference position is detected using the HP sensor 103, the drum phase detection method is changed to a method of detecting a phase with reference to the reference position detected by the HP sensor, whereby it is possible to improve the accuracy of phase detection thereafter.

Further, in a case where en error in drum phase detection becomes larger due to a variation factor, such as a variation in load on the photosensitive drum 107 and a member which is brought into contact with the photosensitive drum 107, the phase detection is switched to phase detection based on detection of the reference position using the HP sensor 103, whereby the accuracy of phase detection is maintained.

In place or in combination of the above, the stop position of the photosensitive drum 107 is controlled such that the HP sensor detects the reference position phase immediately after the start of the photosensitive drum 107 next time. This makes it possible to perform phase detection using the HP sensor immediately after the start of the photosensitive drum, whereby phase detection is always performed based on the output from the HP sensor, which makes it possible to perform phase detection with high accuracy.

Further, even when the load on the photosensitive drum 107 gradually due to aging, by updating the movement amount at the stop and start of the photosensitive drum 107 each time, it is possible to detect a phase of the drum with high accuracy in spite of aging.

Other Embodiments

Embodiments of the present invention can also be realized by a computer of a system or apparatus that reads out and executes computer executable instructions recorded on a storage medium (e.g., non-transitory computer-readable storage medium) to perform the functions of one or more of the above-described embodiment(s) of the present invention, and by a method performed by the computer of the system or apparatus by, for example, reading out and executing the computer executable instructions from the storage medium to perform the functions of one or more of the above-described embodiment(s). The computer may comprise one or more of a central processing unit (CPU), micro processing unit (MPU), or other circuitry, and may include a network of separate computers or separate computer processors. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-042006, filed Mar. 4, 2013, and Japanese Patent Application No. 2014-031428, filed Feb. 21, 2014, which are hereby incorporated by reference herein in their entirety.

What is claimed is:

1. An image forming apparatus including a photosensitive drum, the image forming apparatus comprising:

an image formation unit configured to form an image on the photosensitive drum;

a detection unit configured to detect a reference position serving as a reference for rotation of the photosensitive drum when the photosensitive drum is rotating at a predetermined speed;

a controller configured to control driving of the photosensitive drum;

a first time period measurement unit configured to measure a first time period from when the reference position is detected by said detection unit to when the controller issues a command to stop rotation of the photosensitive drum, after reducing the speed of rotation of the photosensitive drum from the predetermined speed;

a third time period measurement unit configured to measure a third time period that has elapsed from when the speed of rotation of the photosensitive drum reached the predetermined speed to when the reference position is detected by said detection unit, after rotation of the photosensitive drum is started again;

a phase determination unit configured to determine a phase of the photosensitive drum based on the first time period and the third time period; and an image formation control unit configured to control said image formation unit based on the phase of the photosensitive drum determined by said phase determination unit.

2. The image forming apparatus according to claim 1, wherein said phase determination unit determines the phase of the photosensitive drum based on a second distance determined by subtracting a first distance determined by the first time period and a third distance determined by the third time period from a circumferential length of the photosensitive drum.

3. The image forming apparatus according to claim 2, wherein the second distance is determined whenever the reference position is detected by said detection unit, and when a difference between a newly determined second distance and an immediately precedingly determined second distance is larger than a predetermined value, said phase determination unit updates the second distance to the newly determined second distance.

4. The image forming apparatus according to claim 3, wherein when the difference between the newly determined second distance and the immediately precedingly determined second distance is not larger than the predetermined value, said phase determination unit does not update the second distance to the newly determined second distance.

5. The image forming apparatus according to claim 1, wherein:

said image formation unit includes an exposure unit to expose the photosensitive drum, and the image formation control unit adjusts an amount of exposure by said exposure unit according to the phase of the photosensitive drum.

6. An image forming apparatus including a photosensitive drum, the image forming apparatus comprising:

an image formation unit configured to form an image on the photosensitive drum;

a detection unit configured to detect a reference position serving as a reference for rotation of the photosensitive drum when the photosensitive drum is rotating at a predetermined speed;

a controller configured to control driving of the photosensitive drum;

a first rotation amount determination unit configured to determine a first rotation amount over which the photosensitive drum has rotated from when the reference position is detected by said detection unit to when the controller issues a command to stop rotation of the photosensitive drum, after reducing the speed of rotation of the photosensitive drum from the predetermined speed;

a third rotation amount determination unit configured to determine a third rotation amount over which the photosensitive drum has rotated from when the speed of rotation of the photosensitive drum reached the predetermined speed to when the reference position is detected by said detection unit; and a speed reduction control unit configured to determine a second rotation amount by subtracting the first rotation amount and the third rotation amount from a circumferential length of the photosensitive drum, and in reducing the speed of rotation of the photosensitive drum from the predetermined speed, reduce the speed of rotation of the photosensitive drum when the photosensitive drum has rotated by a distance determined subtracting the second rotation amount from the circumferential length of the photosensitive drum after the reference position is detected by said detection unit.

7. The image forming apparatus according to claim 1, wherein the rotational amount of the photosensitive drum is determined based on one of a movement distance of a surface of the photosensitive drum, a rotational angle of the photosensitive drum, or a rotation time of the photosensitive drum.

8. The image forming apparatus according to claim 6, wherein the rotational amount of the photosensitive drum is determined based on one of a movement distance of a surface of the photosensitive drum, a rotational angle of the photosensitive drum, or a rotation time of the photosensitive drum.

* * * * *